US006967578B1

(12) United States Patent
Guida

(10) Patent No.: US 6,967,578 B1
(45) Date of Patent: Nov. 22, 2005

(54) HAND HELD SECURITY LABEL DEACTIVATION DEVICE

(76) Inventor: Robert F. Guida, 7429 Caldwell Rd., Mukwonago, WI (US) 53149

( * ) Notice: Subject to any disclaimer, the term of this patent is extended or adjusted under 35 U.S.C. 154(b) by 36 days.

(21) Appl. No.: 10/828,113

(22) Filed: Apr. 20, 2004

(51) Int. Cl.[7] ..... G08B 13/14
(52) U.S. Cl. ..... 340/572.3; 340/505; 235/462.45
(58) Field of Search ..... 340/505, 572.1, 340/572.3, 572.8; 235/462.45

(56) References Cited

U.S. PATENT DOCUMENTS

| | | | | |
|---|---|---|---|---|
| 5,187,354 A | | 2/1993 | Bengtsson | 235/472 |
| 5,285,182 A | | 2/1994 | Zarembo | 335/284 |
| 5,410,296 A | | 4/1995 | Montbriand et al. | 340/572 |
| 5,594,420 A | * | 1/1997 | Copeland et al. | 340/572.3 |
| 5,920,262 A | * | 7/1999 | Copeland | 340/572.3 |
| 6,054,924 A | * | 4/2000 | Dames et al. | 340/572.6 |
| 6,181,249 B1 | * | 1/2001 | Maitin et al. | 340/572.3 |
| 6,563,423 B2 | * | 5/2003 | Smith | 340/572.1 |

* cited by examiner

*Primary Examiner*—Jeffery Hofsass
*Assistant Examiner*—George Bugg
(74) *Attorney, Agent, or Firm*—Donald J. Ersler

(57) ABSTRACT

A hand held security label deactivation device includes a handle body and a magnet array. The handle body preferably includes a first body half and a second body half. A cover lip is formed on one end of the handle and a cable loop is formed on the other end thereof. At least one of the body halves preferably includes a cavity for retaining a security label. The magnet array includes at least nine magnets retained on a ferrous plate with an alternating pole pattern. An inner perimeter of a magnet cover is sized to receive the magnet array and an outer perimeter of the cover lip. One end of a coiled security cable is preferably attached to the cable loop and the other end is attached to a checkout counter or the like.

18 Claims, 1 Drawing Sheet

HAND HELD SECURITY LABEL DEACTIVATION DEVICE

BACKGROUND OF THE INVENTION

1. Field of the Invention

The present invention relates generally to security labels and more specifically to a hand held security label deactivation device that need only be held in the proximity of the security label to deactivate thereof.

2. Discussion of the Prior Art

Security labels are affixed to many products sold in department stores and the like to prevent theft by shoplifting. The security labels must be deactivated, before the product is taken out of the store or an alarm will go-off at an exit. One method of deactivating a security label is to use a permanent magnet. U.S. Pat. No. 5,187,354 to Bengtsson discloses a hand scanner for reading bar codes and deactivating article surveillance tags. The Bengtsson invention includes one or more permanent magnets in the vicinity of its optical bar-code reading device. U.S. Pat. No. 5,285,182 to Zarembo discloses a desensitizing apparatus for electromagnetic article surveillance system. The Zarembo invention includes desensitizing a marker by passing thereof over a row of magnets. U.S. Pat. No. 5,410,296 to Montbriand et al. discloses a magnetic tag deactivator for pre-existing check-out counters. The Montbriand et al. invention includes a transition plate that is capable of deactivating a magnetically alterable tag.

The above recited patents have one drawback, an object must be swiped over the permanent magnet. In some cases, it may not be possible to swipe an object with a security label over the permanent magnet.

Accordingly, there is a clearly felt need in the art for a hand held security label deactivation device that may be used to deactivate a security label on a large item that cannot be deactivated by a stationary deactivation device, that need only be in the proximity of the security label to deactivate thereof, that includes a security label to prevent theft and includes an anchoring device for preventing theft.

SUMMARY OF THE INVENTION

The present invention provides a hand held security label deactivation device that does not require swiping to deactivate a security label. The hand held security label deactivation device (deactivation device) includes a handle body and a magnet array. The handle body preferably includes a first body half and a second body half. A cover lip is formed on one end of the handle and a cable loop is formed on the other end thereof. A middle portion of the handle body is sized to be securely grasped by an average sized hand. At least one of the body halves preferably includes a cavity for retaining a security label. The magnet array includes at least nine magnets retained on a ferrous plate with an alternating pole pattern. The at least nine magnets are preferably a permanent type of magnet. An inner perimeter of a magnet cover is sized to receive the magnet array and an outer perimeter of the cover lip. One end of a coiled security cable is preferably attached to the cable loop and the other end is attached to a checkout counter or some other stationary object.

Accordingly, it is an object of the present invention to provide a deactivation device, which may be used to deactivate a large item that cannot be deactivated by a stationary deactivation device.

It is a further object of the present invention to provide a deactivation device, which need only be in the proximity of the security label to deactivate thereof.

It is yet a further object of the present invention to provide a deactivation device, which includes a security label to prevent theft thereof.

Finally, it is another object of the present invention to provide a deactivation device, which includes an anchoring device for preventing theft thereof.

These and additional objects, advantages, features and benefits of the present invention will become apparent from the following specification.

DETAILED DESCRIPTION OF THE PREFERRED EMBODIMENTS

Figure 1:
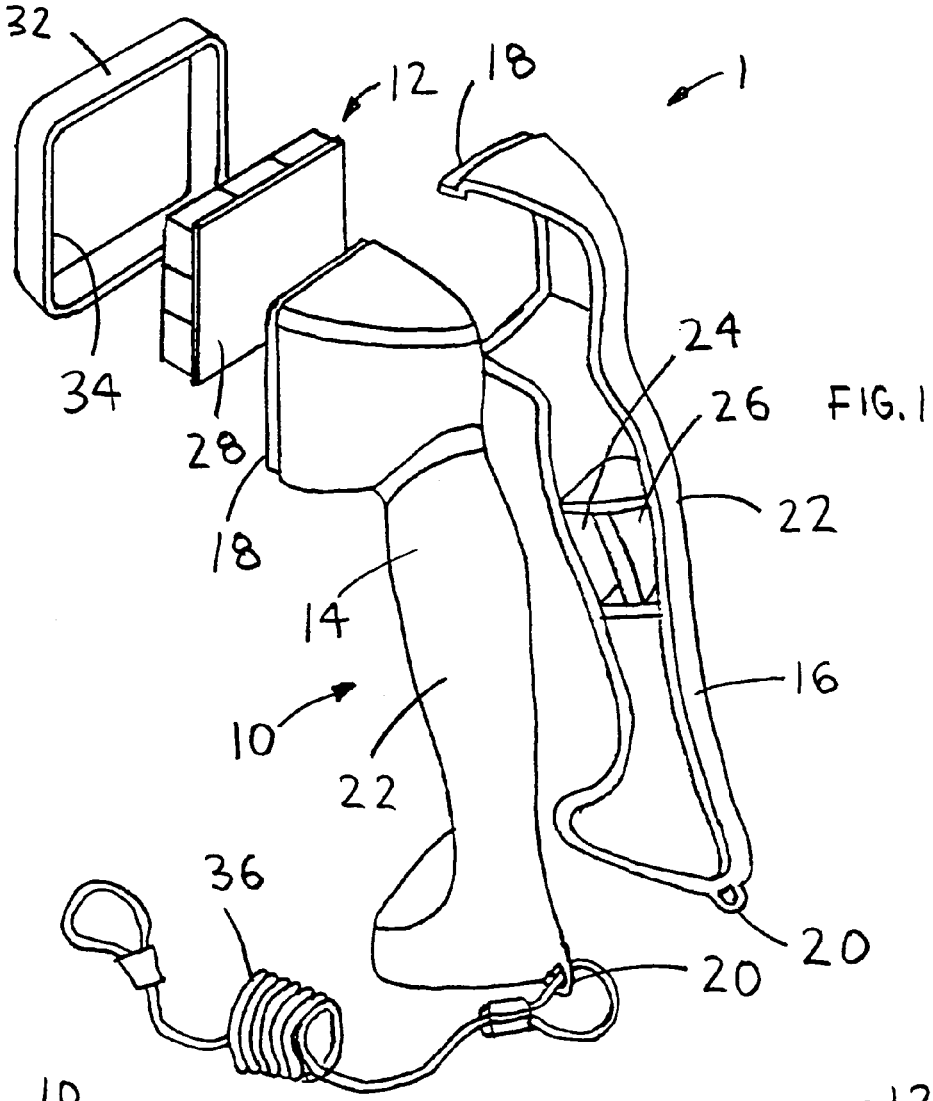
FIG. 1 is a partially exploded perspective view of a deactivation device in accordance with the present invention.

With reference now to the drawings, and particularly to FIG. 1, there is shown a partially exploded perspective view of a deactivation device 1. The deactivation device 1 includes a handle body 10 and a magnet array 12. The handle body 10 preferably includes a first body half 14 and a second body half 16. A cover lip 18 is formed on one end of the handle body 10 and a cable loop 20 is formed on the other end thereof. A middle portion 22 of the handle body 10 is sized to be securely grasped by an average sized hand. At least one of the body halves preferably includes a cavity 24 for retaining a security label 26. The first and second body halves are assembled to each other with any suitable attachment method, such as glue or security screws. The security label 26 is secured in the cavity 24 with glue or any other suitable method.

Figure 2:
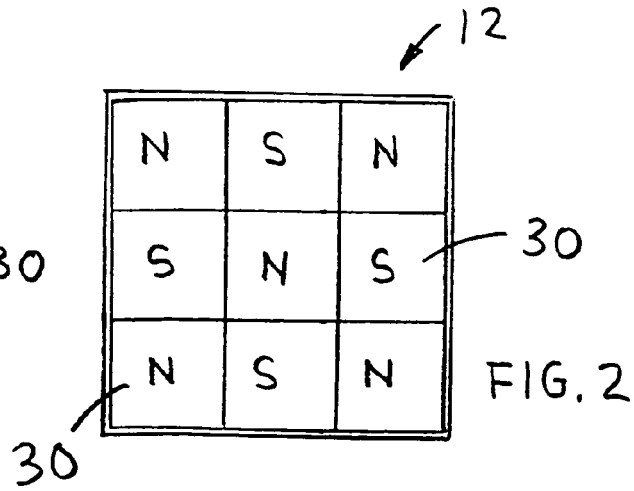
FIG. 2 is a front view of a magnet array of a deactivation device in accordance with the present invention.

With reference to FIG. 2, the magnet array 12 includes at least nine magnets 30 retained on a ferrous plate 28. The ferrous plate 28 is preferably fabricated from steel, but other ferrous materials may also be used. The at least nine magnets 30 are preferably fabricated from a Neodymium Iron Boron Grade 40 magnet material. However, other permanent magnet materials may also be used. It is also preferable to coat each magnet 30 with a nickel, phenolic or other suitable coating to prevent rusting.

The at least nine magnets 30 are preferably arranged in a square with at least three rows and at least three columns. The pole orientations of adjacent magnets 30 alternate between north (N) and south (S) poles. The at least nine magnets 30 are retained on the ferrous plate 28 with magnetic attraction. An inner perimeter 34 of a magnet cover 32 is sized to receive an outer perimeter of the cover lip 18 and an outer perimeter of the magnet array 12. The magnet cover 32 is retained on the cover lip 18 with any suitable attachment method, such as glue.

Figure 3:
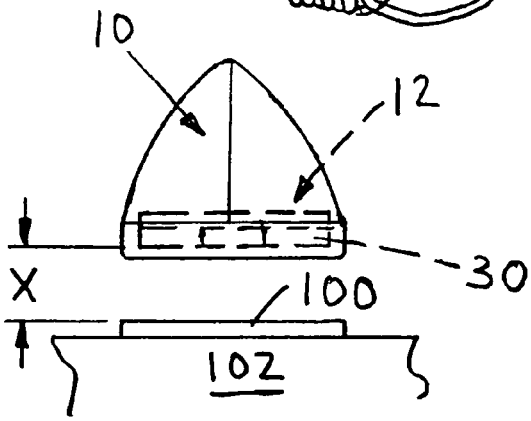
FIG. 3 is an end view of a magnet array of a deactivation device in proximity to a security label in accordance with the present invention.

The at least three rows and at least three columns configuration of magnets 30 allow a security label to be deactivated by merely bringing magnet cover 32 near or in the proximity of the security label. The following dimensions are given by way of example and not by way of limitation. With reference to FIG. 3, when each magnet 30 has a dimension of ½ inch square and ¼ inch thick, the distance between a front of the at least nine magnets 30 and a security label 100 on an item 102 may be as much as the dimension "X". The dimension "X" is ½ inch. The prior art requires sliding or swiping an object with a security label across a magnet structure.

One end of a coiled security cable 36 is preferably attached to the cable loop 20 and the other end is attached to a stationary object, such as a checkout counter. However, retaining devices other than the coiled security cable 36 may also be used to retain the deactivation device 1. A security label will be deactivated by bringing the magnet array 12 near or in the proximity of the security label. The security label may also be deactivated by contacting thereof with the magnet array or sliding the magnet array over the security label.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of deactivating a security label on an item, comprising the steps of:

providing a magnet array including at least nine magnets retained on a ferrous plate, said at least nine magnets being retained in at least three rows and at least three columns, each one of said at least nine magnets having a pole orientation that is different from a magnet adjacent to thereof; and deactivating a security label on an object by bringing said magnet array in at least the proximity of the security label.

2. The method of deactivating a security label on an item of claim 1, further comprising the step of:

affixing said magnet array to a handle.

3. The method of deactivating a security label on an item of claim 2, further comprising the step of:

inserting said magnet array into a magnet cover, attaching said magnet cover to one end of said handle.

4. The method of deactivating a security label on an item of claim 3, further comprising the step of:

attaching one end of a retaining device to the other end of said handle, attaching the other end of said retaining device to a stationary object.

5. The method of deactivating a security label on an item of claim 2, further comprising the step of:

inserting a security label inside said handle.

6. The method of deactivating a security label on an item of claim 2, further comprising the step of:

forming said handle from a first half and a second half.

7. The method of deactivating a security label on an item of claim 3, further comprising the step of:

forming a cover lip on said one end of said handle, forming an inner perimeter in said magnet cover, said inner perimeter being sized to receive said cover lip and said magnet array.

8. A method of deactivating a security label on an item, comprising the steps of:

providing a magnet array including at least nine magnets retained on a ferrous plate, said at least nine magnets being retained in at least three rows and at least three columns, each one of said at least nine magnets having a pole orientation that is different from a magnet adjacent to thereof;

affixing said magnet array to a handle; and deactivating a security label on an object by bringing said magnet array in at least the proximity of the security label.

9. The method of deactivating a security label on an item of claim 8, further comprising the step of:

inserting said magnet array into a magnet cover, attaching said magnet cover to one end of said handle.

10. The method of deactivating a security label on an item of claim 9, further comprising the step of:

attaching one end of a retaining device to the other end of said handle, attaching the other end of said retaining device to a stationary object.

11. The method of deactivating a security label on an item of claim 8, further comprising the step of:

inserting a security label inside said handle.

12. The method of deactivating a security label on an item of claim 8, further comprising the step of:

forming said handle from a first half and a second half.

13. The method of deactivating a security label on an item of claim 8, further comprising the step of:

forming a cover lip on said one end of said handle, forming an inner perimeter in said magnet cover, said inner perimeter being sized to receive said cover lip and said magnet array.

14. A method of deactivating a security label on an item, comprising the steps of:

providing a magnet array including at least nine magnets retained on a ferrous plate, said at least nine magnets being retained in at least three rows and at least three columns, each one of said at least nine magnets having a pole orientation that is different from a magnet adjacent to thereof;

affixing said magnet array to a handle;

inserting said magnet array into a magnet cover, attaching said magnet cover to one end of said handle; and deactivating a security label on an object by bringing said magnet array in at least the proximity of the security label.

15. The method of deactivating a security label on an item of claim 14, further comprising the step of:

attaching one end of a retaining device to the other end of said handle, attaching the other end of said retaining device to a stationary object.

16. The method of deactivating a security label on an item of claim 14, further comprising the step of:

inserting a security label inside said handle.

17. The method of deactivating a security label on an item of claim 14, further comprising the step of:

forming said handle from a first half and a second half.

18. The method of deactivating a security label on an item of claim 14, further comprising the step of:

forming a cover lip on said one end of said handle, forming an inner perimeter in said magnet cover, said inner perimeter being sized to receive said cover lip and said magnet array.

* * * * *